US009950324B2

(12) United States Patent
Chappard

(10) Patent No.: US 9,950,324 B2
(45) Date of Patent: Apr. 24, 2018

(54) SEPARATOR BY FOUCAULT CURRENT

(71) Applicant: MAGPRO, Trept (FR)

(72) Inventor: Eric Chappard, Roanne (FR)

(73) Assignee: MAGPRO, Trept (FR)

( * ) Notice: Subject to any disclaimer, the term of this patent is extended or adjusted under 35 U.S.C. 154(b) by 0 days.

(21) Appl. No.: 14/394,447

(22) PCT Filed: Apr. 12, 2013

(86) PCT No.: PCT/FR2013/000100
§ 371 (c)(1),
(2) Date: Oct. 14, 2014

(87) PCT Pub. No.: WO2013/153296
PCT Pub. Date: Oct. 17, 2013

(65) Prior Publication Data

US 2015/0076039 A1 Mar. 19, 2015

(30) Foreign Application Priority Data

Apr. 12, 2012 (FR) ..... 12 01088

(51) Int. Cl.

| | |
|---|---|
| ***B03C 1/00*** | (2006.01) |
| ***B03C 1/247*** | (2006.01) |
| ***B03C 1/18*** | (2006.01) |
| *B03C 1/02* | (2006.01) |

(52) U.S. Cl.
CPC ..... *B03C 1/247* (2013.01); *B03C 1/18* (2013.01); *B03C 1/02* (2013.01); *B03C 2201/20* (2013.01)

(58) Field of Classification Search
CPC .... B03C 1/02; B03C 1/12; B03C 1/23; B03C 1/24; B03C 1/247; B03C 2201/20
USPC ..... 209/212, 221
See application file for complete search history.

(56) References Cited

U.S. PATENT DOCUMENTS

| | | | |
|---|---|---|---|
| 3,448,857 | A | 6/1969 | Benson et al. |
| 5,057,210 | A | 10/1991 | Julius |
| 5,092,986 | A | 3/1992 | Feistner et al. |

FOREIGN PATENT DOCUMENTS

| | | | |
|---|---|---|---|
| DE | 40 31 585 | A1 | 4/1992 |
| DE | 42 23 812 | C1 | 8/1993 |
| DE | 43 17 640 | A1 | 12/1994 |
| DE | 198 38 170 | A1 | 3/2000 |

(Continued)

OTHER PUBLICATIONS

Jul. 22, 2013 Search Report issued in International Patent Application No. PCT/FR2013/000100 (with translation).

(Continued)

*Primary Examiner* — Joseph C Rodriguez
*Assistant Examiner* — Kalyanavenkateshware Kumar
(74) *Attorney, Agent, or Firm* — Oliff PLC

(57) ABSTRACT

This separator by Foucault current comprises an endless conveyor belt designed to transport the mixture to a sorting section, rotary drums on which the endless conveyor belt runs, and a multipole magnetic rotor driven in rotation so as to generate an alternating induction magnetic field. The sorting section is offset with respect to each rotary drum along the path of the endless conveyor belt. The magnetic rotor is arranged outside each rotary drum. The path of the endless conveyor belt comprises a discharge area which follows on from the sorting section.

12 Claims, 2 Drawing Sheets

(56) References Cited

FOREIGN PATENT DOCUMENTS

| | | | | | |
|---|---|---|---|---|---|
| EP | 0 439 983 | A2 | | 8/1991 | |
| EP | 1 985 370 | A1 | | 10/2008 | |
| EP | 1985370 | A1 | * | 10/2008 | ..... B03C 1/18 |
| EP | 2 289 628 | A1 | | 3/2011 | |
| ES | 2 182 716 | A1 | | 3/2003 | |
| FR | 2 671 291 | A1 | | 7/1992 | |
| FR | 2 712 208 | A1 | | 5/1995 | |

OTHER PUBLICATIONS

Translation of Oct. 14, 2014 International Preliminary Report on Patentability issued in International Patent Application No. PCT/FR2013/000100.

Jan. 29, 2016 Office Action issued in Mexican Patent Application No. MX/a/2014/012145.

* cited by examiner

Fig. 2
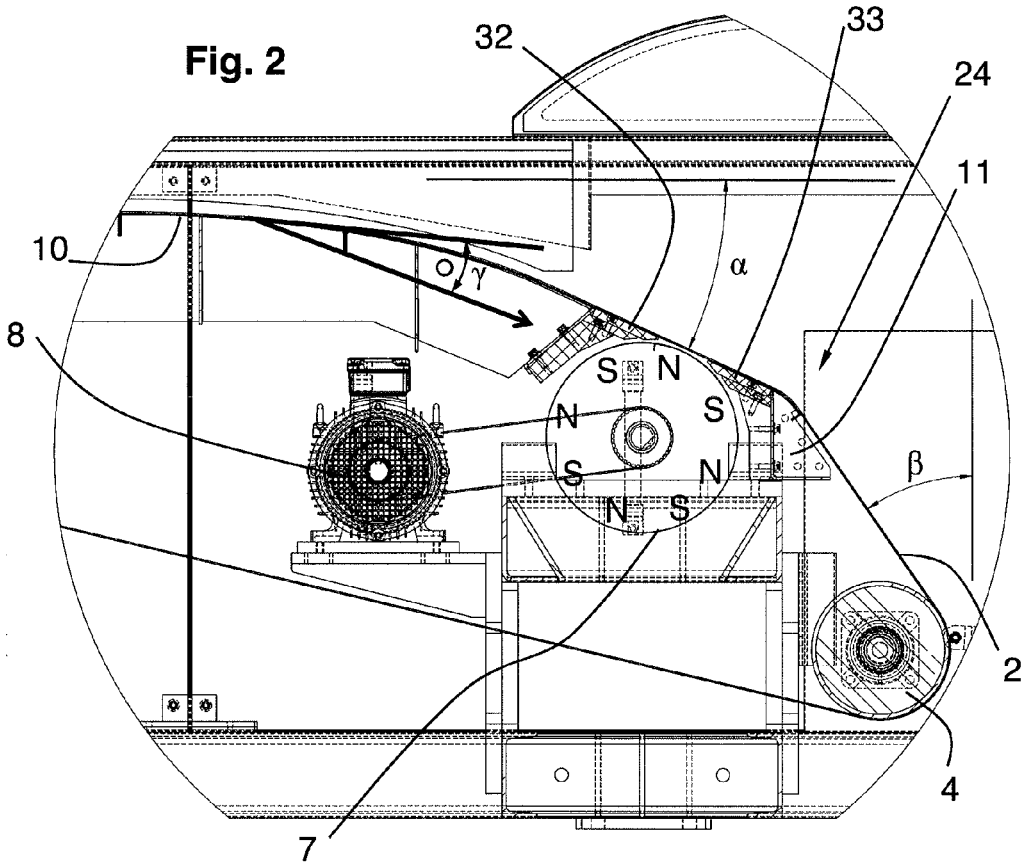
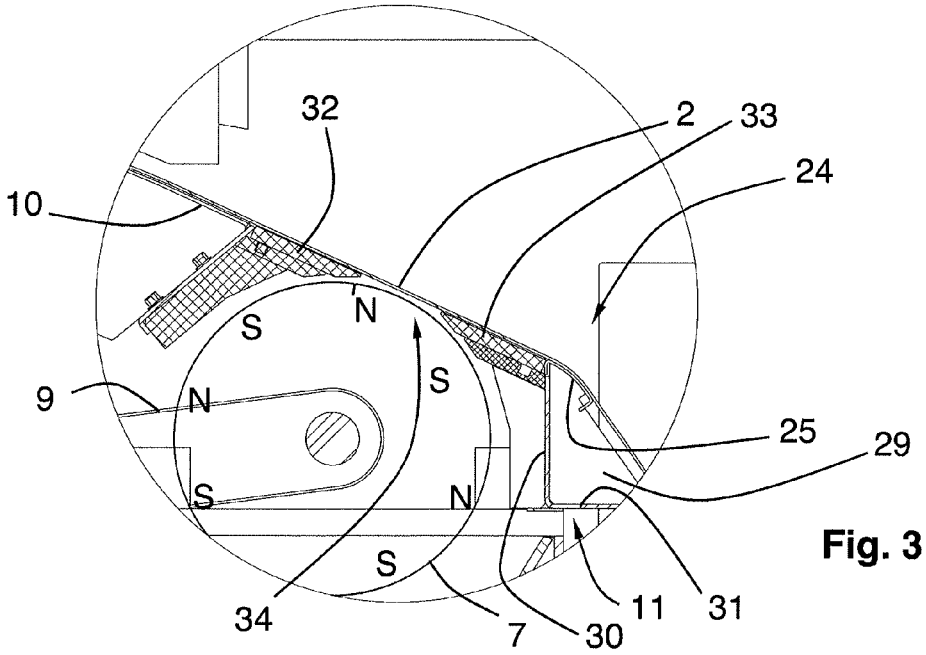
Fig. 3

SEPARATOR BY FOUCAULT CURRENT

BACKGROUND OF THE INVENTION

The invention relates to the field of sorting of mixed solid materials, such as those originating from waste crushing. More precisely, the invention relates to a separator by Foucault current (also called Eddy current) for removing non-magnetizable conductive elements from a mixture of materials. The type of separator in question comprises:

- An endless conveyor belt designed to transport the mixture to a sorting section and driven in a direction of progression along a path comprising this sorting section,
- rotary drums on which the conveyor belt runs,
- a multipole magnetic rotor able to be driven in rotation so as to generate an alternating magnetic field so as to induce Foucault currents in said conductive elements and to divert these conductive elements at the level of the sorting section.

STATE OF THE ART

Separation by Foucault current is used to separate conductive and non-magnetizable elements from an inert, i.e. non-conductive, fraction which can contain cardboard, plastics, ceramic, etc. Separation by Foucault current can also be used to sort non-magnetizable fragments according to their electric conductivities.

A separator by Foucault current of the above-mentioned type is described in U.S. Pat. No. 3,448,857. It comprises a conveyor belt transporting the mixture to be treated to one end where this belt makes a half-turn on a belt drum. In this belt drum, a multipole magnetic rotor is driven at high speed so as to generate an alternating magnetic field which rotates faster than the belt drum. The mixture is swept by this magnetic field which induces Foucault currents in the conductive fragments of the mixture and which further exerts a repulsion according to these Foucault currents. The most conductive fragments are the seat of the highest Foucault currents and are subjected to the strongest repulsion, so that their exit trajectories are the most greatly diverted in an elongation direction. The fragments having little or no conductivity fall off the conveyor belt without moving far from the latter.

The magnetic rotor has to be as close as possible to the conveyor belt and therefore to the belt drum, whereas it is rotating at a much higher speed than this belt drum. This can only be achieved by means of a complex mechanical assembly which operates in a dusty environment which is harsh for the equipment.

It can furthermore happen that ferromagnetic particles pass underneath the conveyor belt and are thus retained against the belt drum due to their attraction by the magnetic rotor. Such ferromagnetic particles retained in this way in the rotating magnetic field heat due to the effect of induced currents.

The conveyor belt is however mainly made from polymer which is liable to melt at low temperature. It can therefore be damaged by a local temperature increase caused by a captive ferromagnetic particle. The problem of melting or of other damage by heating locally caused by a captive ferromagnetic particle also arises for the belt drum, which is made from a material which must not be conductive and which is often a composite material. The ferro-magnetic particles trapped on the belt drum thus cause damage which gives rise to both premature shutdowns and expensive repairs.

In U.S. Pat. No. 5,092,986, a solution is proposed having the purpose of remedying the shortcomings set out above. Comprising a reduction of the diameter of the magnetic rotor and an eccentric arrangement of this magnetic rotor with respect to the belt drum, this solution represents an improvement which is however only partial. The shortcomings of the device described in the above-mentioned U.S. Pat. No. 3,448,857 are still present in the device proposed by the U.S. Pat. No. 5,092,986, even if the solution presented in the latter Patent has attenuated them.

Other drawbacks are common to the devices of the above-mentioned U.S. Pat. Nos. 3,448,857 and 5,092,986. One of these is the high cost and the short lifetime of the belt drum made from composite material. This belt drum also presents the drawback of being difficult and lengthy to replace. Its presence also makes it difficult to replace the conveyor belt, whereas the latter is a wear part. Another drawback resides in the fact that once it has been fitted in place, the belt drum is hardly accessible and a genuine visual inspection of its state cannot be performed. This results in the belt drum often breaking unforeseeably, in operation, which can cause large damage, including breaking of the magnetic rotor.

SUMMARY OF THE INVENTION

The object of the invention is at least to enable easier and more dependable operation of a separator by Foucault current of the above-mentioned type.

This object tends to be achieved by providing a separator by Foucault current for removing non-magnetizable conductive elements from a mixture of materials, comprising:

- a endless conveyor belt to transport the mixture of materials,
- rotary drums on which the endless conveyor belt runs, at least one of the rotary drums driving the endless conveyor belt in a direction of progression along an outward path comprising an acceleration section in which the endless conveyor belt is configured to drive the mixture of materials at the speed of the endless conveyor belts,
- a multipole magnetic rotor configured to generate an alternating magnetic field passing through the endless conveyor belt and configured to divert the non-magnetizable conductive elements.

Furthermore, the outward path of the endless conveyor belt comprises a sorting section in which the endless conveyor belt follows a downward rectilinear trajectory downstream from the acceleration section, the multipole magnetic rotor being located in the sorting section so as to divert the non-magnetizable conductive elements when the latter pass through the sorting section. The multipole magnetic rotor is arranged facing the endless conveyor belt at the level of the sorting section so that the endless conveyor belt is separated from the multipole magnetic rotor by an air-gap.

The separator by Foucault current defined in the foregoing can incorporate one or more other advantageous features, either alone or in combination, in particular among those defined below.

Advantageously, the slope of the sorting section is less than 45°.

Advantageously, the path of the endless conveyor belt comprises a connecting section having a progressive downwards inflection and connecting the acceleration section to the sorting section. Preferably, at any point of the progressive increase of the downward slope in the connecting section, the path of the endless conveyor belt is above a disengagement trajectory of the mixture of material due to the effect of an inertia which this mixture possesses when said mixture is driven along said path at a maximum speed of the endless conveyor belt.

Advantageously, the path of the endless conveyor belt comprises a discharge area which follows on from the sorting section. The separator comprises, a slideway in this discharge area, defining a slide ramp on which the path of the endless conveyor belt inflects downwards. Preferably, the fixed slideway is made from stainless steel and in more preferential manner from 316L stainless steel.

Advantageously, the endless conveyor belt is stretched longitudinally between the connecting section and the discharge section so as to act against a possible depression of the endless conveyor belt into the air-gap at the level of the sorting section due to the action of gravitation.

Advantageously, the separator comprises at least one support pad of the endless conveyor belt keeping the latter away from the rotary rotor, in the sorting section.

BRIEF DESCRIPTION OF THE DRAWINGS

Other advantages and features will become more clearly apparent from the following description of a particular embodiment of the invention given for non-restrictive example purposes only and represented in the appended drawings, in which:

FIG. 2 is an enlargement of the magnifying glass noted II in FIG. 1, FIG. 3 is an enlargement of the magnifying glass noted III in the same FIG. 1.

DESCRIPTION OF A PREFERRED EMBODIMENT OF THE INVENTION

Figure 1:
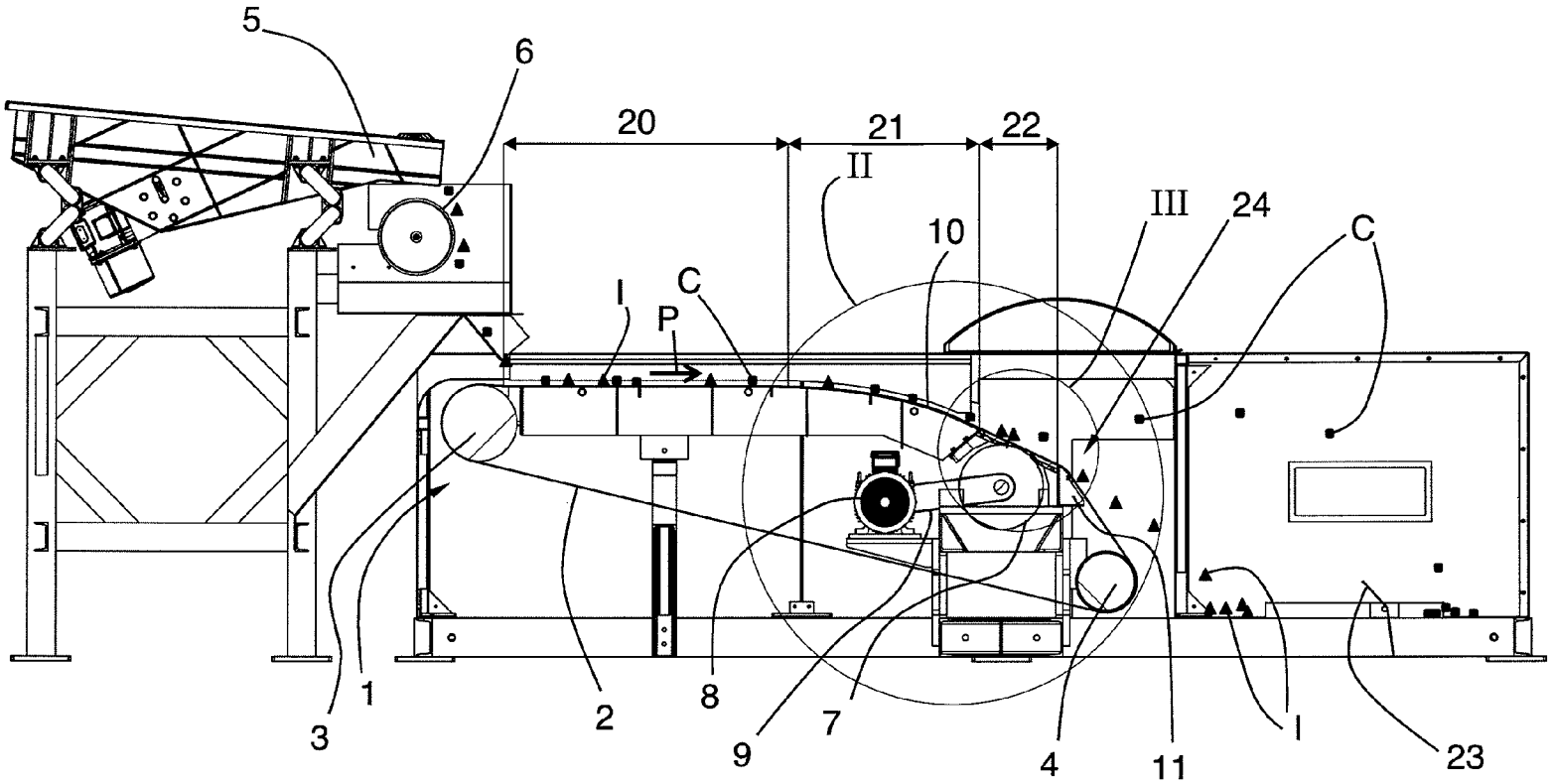
FIG. 1 is a schematic view, in longitudinal cross-section, of a separator by Foucault current according to the invention.

In FIG. 1, a separator by Foucault current according to the invention comprises a conveyor 1, the endless conveyor belt 2 of which is kept taut by two belt end drums opposite one another, i.e. a return drum 3 on entry and a return drum 4 on exit. The arrow P symbolises the direction of progression of endless conveyor belt 2 driven at least by drum 3.

In other words, conveyor belt 2 is stretched between rotary drums 3 and 4 on which it runs. At least one of the drums, for example drum 3, drives conveyor belt 2 in the direction of progression P. Conveyor belt 2 follows an outward path in the direction of progression P between respectively drums 3 and 4. The outward path comprises an acceleration section 20 in which the mixture of materials is received and stabilised on conveyor belt 2. Furthermore, acceleration section 20 is configured to drive the mixture of materials at the speed of conveyor belt 2.

In the present text and in the appended claims, the terms "upstream", "downstream", "follow", and "descend", and any similar terms, refer to the direction of progression P of the conveyor belt along its outward path.

A vibrating feed trough 5 is arranged to discharge a mixture of heterogeneous solid materials, such as crushed waste, to an input of conveyor belt 2. A magnetised extraction roller 6 of the ferromagnetic elements that may be present in the mixture of materials is located on the downward path followed by this mixture from trough 5.

Conveyor belt 2 conveys the mixture of heterogeneous materials to the location of a multipole magnetic rotor 7 which is mounted rotating inside conveyor belt 2, between drums 3 and 4. In the manner known as such for example from the above-mentioned American Patents U.S. Pat. Nos. 3,448,857 and 5,092,986, this magnetic rotor 7 comprises an annular succession of magnets which are arranged in such a way that the north magnetic poles N and south magnetic poles S alternate in peripheral manner. Known as such, magnetic rotor 7 is schematised in FIGS. 1 to 3, for the sake of clarity.

A motor 8 drives magnetic rotor 7 at high speed, for example about 3000 rpm. Magnetic rotor 7 can be driven by motor 8, for example via a coupling belt 9.

Magnetic rotor 7 and in particular motor 8 which drives the latter are configured so that magnetic rotor 7 generates a rotating magnetic field passing through conveyor belt 2 to perform sweeping above this belt 2. The mixture of materials is thus subjected to an alternating magnetic field which enables non-magnetizable conductive elements C to be diverted.

In an upstream part of its outward path, conveyor belt 2 slides on a support ramp 10 which guides it and which has the function of supporting the weight of the mixture of heterogeneous materials when the latter pass on the belt. At the level of magnetic rotor 7, conveyor belt 2 is stretched tight between support ramp 10 and a fixed slideway 11.

Support ramp 10 guides conveyor belt 2 and, in doing so, defines the shape of an upstream part of the outward path of this conveyor belt 2. This outward path of conveyor belt 2 comprises: upstream acceleration section 20 of the mixture of materials, preferably a connecting section of progressive inflection 21, and a sorting section 22, which follow on from one another. Acceleration section 20 is preferably substantially horizontal. Acceleration section 20 is configured in such a way that the mixture of materials reaches the same speed as conveyor belt 2 in this section. Magnetic rotor 7 is located in sorting section 22, where a separation is made among the materials of the mixture.

The mixture of heterogeneous materials comprises electrically conductive elements C and elements I which are hardly or not all conductive. Conductive elements C can comprise non-ferrous metal parts, for example made from aluminium. Among the elements which are hardly or not all conductive, there may be cardboard, plastic and/or ceramic for example.

In sorting section 22, magnetic rotor 7 generates a rotating magnetic field which passes through conveyor belt 2 and performs sweeping above this belt 2. This sweeping is faster than conveyor belt 2, so that the mixture of material is subjected to an alternating magnetic field which induces Foucault currents in conductive elements C. The same alternating field diverts conductive elements C through which such Foucault currents flow and which are thus temporarily transformed into electric magnets. Diversion by the magnetic field takes place in the direction of an elongation of the flight paths that conductive elements C have after they have become disengaged from belt 2. These conductive elements C and the other elements I of the mixture are not propelled at the same distance from the output of conveyor belt 1 and land in two different reception areas separated from one another by a separating flap 23. In this way, conductive elements C present in the mixture of materials are separated and removed from this mixture.

In advantageous manner, belt 2 follows a downward rectilinear trajectory, in sorting section 22, downstream from acceleration section 20. Indeed, as illustrated in FIG. 2, the path of belt 2 has a descending slope in the downstream direction in sorting section 22. Disengagement of conductive elements C away from conveyor belt 2 takes place in a direction which is upwardly inclined with respect to the horizontal. The descending slope of sorting section 22 advantageously reduces the incline of the direction of disengagement of conductive elements C, so that the latter have flight paths that are as long as possible.

Furthermore, multipole magnetic rotor 7 is arranged facing conveyor belt 2 in sorting section 22 so that conveyor belt 2 is separated from multipole magnetic rotor 7 by an air-gap.

A taut conveyor belts passing through a rectilinear sorting section makes it possible to use slideways to direct the path of the conveyor belt in the sorting section. For a sorting section having a curved shape, the use of slideways in contact with the conveyor belt is in fact necessary. Furthermore, a contact between the conveyor belt and slideways in a sorting section through which a rotating magnetic field passes enhances trapping of particles.

This astute configuration of the separator thus advantageously enables trapping of particles in the different elements of the separator arranged in sorting section 22 to be minimised, thereby improving the reliability of the separator. The trapped particles, in particular ferromagnetic particles, do in fact cause damage and wear to the different elements forming the separator, in particular the conveyor belt, slideways, drums, etc.

Furthermore, the ferromagnetic particles which may pass underneath conveyor belt 2 are advantageously repelled by the ventilation produced by the rotation of magnetic rotor 7 which does not rotate in a confined space. If ferromagnetic particles do however reach magnetic rotor 7, they are fixed on this magnetic rotor 2 and rotate with it without being able to heat by induction. There is thus no, or very little, risk of conveyor belt 2 being damaged due to heating of a trapped ferromagnetic particle.

In the Foucault separator of FIGS. 1 to 3, there is no belt end drum surrounding magnetic rotor 7. The costs, fragility and other previously mentioned drawbacks of such a belt end drum are consequently non-existent.

In the foregoing, this results in the separator by Foucault current represented in FIGS. 1 to 3 having a dependable and robust operation. Operation thereof is thereby greatly facilitated.

In the same manner, it can be noted that conveyor belt 2 can be replaced quickly.

In preferential manner, the downward slope of the path of conveyor belt 2 in sorting section 22 results in an angle $\alpha$ between this path and the horizontal. This angle $\alpha$ is advantageously less than 45°, preferably comprised between 15° and 35°, and in even more preferential manner is about 25°.

Advantageously, the path of conveyor belt 2 comprises connecting section 21 connecting acceleration section 20 to sorting section 22. The connecting section is formed in such a way as to have a progressive downward inflection. In other words, at the level of connecting section 21, the path of conveyor belt 2 preferably goes from a substantially zero slope to the slope of sorting section 22, inflecting progressively downwards as it advances downstream. At the input of connecting section 21, the path of conveyor belt 2 acquires a descending slope in the downstream direction, which increases progressively in the downstream direction along this connecting section 21. This progressive slope increase is chosen to prevent the mixture of materials from losing its adherence to conveyor belt 2 due to the effect of its inertia. The path of conveyor belt 2 in fact comprises inclined connecting and sorting sections 21 and 22. The incline of a path and the speed of a conveyor belt, i.e. the path taken by the waste materials, constitute two essential parameters which have a major influence on the inertia of a waste product of the mixture and which thus define its trajectory. What is meant by trajectory of a waste product is a curve described by the centre of gravity of the waste product.

In advantageous manner, the path of conveyor belt 2 in connecting section 21 is determined by successive downstream iterations from the entry of this connecting section 21, so that at any point along the progressive downward slope increase, the path of the conveyor belt is slightly above a disengagement trajectory of the mixture of material due to the effect of its inertia at a maximum speed of conveyor belt 2. A slope increase taking place very slowly results in a long connecting section 21 and therefore in a large space occupation. At any point along said progressive downward slope increase, the path of the conveyor belt has a smaller incline with respect to the horizontal, of non-zero quantity $\gamma$, than the disengagement trajectory of the mixture of material due to the effect of its inertia at a maximum speed of conveyor belt 2. This advantageous configuration of connecting section 21 enables the mixture of waste to be conveyed to inclined sorting section 22 with an optimal speed while at the same time preventing the waste from being removed from conveyor belt 2.

The path of conveyor belt 2 comprises a discharge area 24 where discharge of elements I takes place. This discharge area 24 immediately follows on from sorting section 22. The path of conveyor belt 2 undergoes a downward inflection therein which determines a slide ramp 25 for sliding of this conveyor belt 2. This inflection leads to a descent which forms a non-zero angle $\beta$ with the vertical. Slide ramp 25 is constitutive of fixed slideway 11.

On account of its tension, conveyor belt 2 exerts a large thrust on fixed slideway 11, which has to be sufficiently robust to be able to contain this thrust. Moreover, a great deal of friction takes place between slide ramp 25 and conveyor belt 2.

In the foregoing, it is apparent that the mechanical stresses involved in choosing slideway 11 are high. An additional stress arises from the fact that this slideway 11 is located in the magnetic field produced by rotor 7, so that induced currents may occur therein and lead to a prohibitive temperature rise.

It was found that the set of stresses mentioned above could be overcome by means of a fixed slideway 11 made from 316L stainless steel, according to the Standard established by the American Iron and Steel Institute, referred to as AISI Standard. 316L stainless steel according to the AISI Standard is Z2CND17-12 stainless steel according to French Standard NF A 35573. It is also referenced as X2CrNiMo18-10 1.4404 stainless steel according to European Standard EN 10027.

As can be clearly seen in FIG. 3, fixed slideway 11 comprises two transverse wings 30 and 31 connected by a fold. The upstream portion of slide ramp 25 connects onto longitudinal wing 30. Following on from one another in a transverse row, plates 29 form reinforcement gussets connecting slide ramp 25 to each of wings 30 and 31.

Magnetic rotor 7 is engaged in a space which the downstream end of the structure defining support ramp 10 and fixed slideway 11 delineate between them, in other words between connecting section 21 and discharge area 24. Sorting section 22, in which conveyor belt 2 is separated from multipole magnetic rotor 7 by the air-gap, is located at the level of this space. Furthermore, conveyor belt 2 is stretched longitudinally between connecting section 21 and discharge area 24 so as to act against a depression of conveyor belt 2 into the air-gap at the level of sorting section 22 due to the action of gravitation.

Furthermore, in the top part of said space, an upstream pad 32 and a downstream pad 33 have a top surface running along the path of conveyor belt 2. Made from composite material, these pads 32 and 33 are designed to perform support of conveyor belt 2 in the case of an excessive load passing on the latter so as to keep this conveyor belt 2 away from magnetic rotor 7 in such a case.

Between pads 32 and 33, a transverse slot 34 releases a free space between a rear surface of conveyor belt 2 and a top portion of magnetic rotor 7. In other words, the air-gap separating magnetic rotor 7 and conveyor belt 2 is arranged between pads 32 and 33.

The absence of a drum between conveyor belt 2 and magnetic rotor 7 offers several new possibilities, which is advantageous. In particular, magnetic rotor 7 can be moved towards conveyor belt 2 so that a more intense magnetic field acts on the mixture of materials at separation level. Another possibility is to increase the thickness of conveyor belt 2. Yet another possibility consists in preserving a large safety distance between conveyor belt 2 and magnetic rotor 7.

The invention is not limited to the embodiments described in the foregoing. In particular, at least a portion of fixed slideway 21 may not be made from 316L stainless steel. For example, this fixed slideway 21 can be wholly or partially made from ceramic. It can also result from assembly of several elements made from different materials. For example, a first and second portion of fixed slideway 21 can respectively be made from ceramic and from 316L stainless steel.

The invention claimed is:

1. A separator by Foucault current for removing non-magnetizable conductive elements from a mixture of materials, comprising:

an endless conveyor belt configured to transport the mixture of materials;

rotary drums on which the endless conveyor belt runs, at least one of the rotary drums driving the endless conveyor belt in a direction of progression along an outward path comprising an acceleration section in which the endless conveyor belt is configured to drive the mixture of materials at a speed of the endless conveyor belt;

a first fixed support and a second fixed support, wherein the endless conveyor belt is stretched tight between the first fixed support and the second fixed support so as to define a sorting section, wherein the endless conveyor belt is in contact with the first and second fixed supports to impose a descending rectilinear trajectory to the endless conveyor belt in the sorting section; and a multipole magnetic rotor being different from the first fixed support and the second fixed support and arranged between the first fixed support and the second fixed support so that the endless conveyor belt is separated from the multipole magnetic rotor only by an air-gap, the multipole magnetic rotor being configured to generate an alternating magnetic field passing through the endless conveyor belt and to divert the non-magnetizable conductive elements passing by the sorting section, wherein the path of the endless conveyor belt comprises a connecting section connecting the acceleration section to the sorting section, the connecting section having a progressive downwards inflection forming a progressive descending slope increase in the connecting section.

2. The separator by Foucault current according to claim 1, wherein the path of the endless conveyor belt in the sorting section forms with the horizontal direction a downward slope less than 45°.

3. The separator by Foucault current according to claim 1, wherein the path of the endless conveyor belt comprises a discharge area which follows on from the sorting section, and wherein the separator comprises in this discharge area a fixed slideway defining a slide ramp on which the path of the endless conveyor belt inflects downwards.

4. The separator by Foucault current according to claim 3, wherein the fixed slideway is made from stainless steel.

5. The separator by Foucault current according to claim 3, wherein the fixed slideway is made from 316L stainless steel.

6. The separator by Foucault current according to claim 3, wherein the endless conveyor belt is tightly stretched longitudinally between the connecting section and the discharge area so as to act against a depression of the endless conveyor belt in the sorting section due to the action of gravitation.

7. The separator by Foucault current according to claim 1, comprising at least one support pad of the endless conveyor belt keeping the latter away from the rotary rotor, in the sorting section.

8. The separator by Foucault current according to claim 1, wherein at any point along the progressive descending slope increase in the connecting section, the path of the endless conveyor belt is above a disengagement trajectory of the mixture of material due to the effect of an inertia which this mixture possesses when said mixture is driven along said path at a maximum speed of the endless conveyor belt.

9. The separator by Foucault current according to claim 1, wherein the multipole magnetic rotor carries out a magnetic field that does not overlap the endless conveyor belt beyond the first fixed support between the sorting section and the acceleration section.

10. The separator by Foucault current according to claim 1, wherein the acceleration section is substantially horizontal.

11. The separator by Foucault current according to claim 1, wherein the first fixed support is upstream from the second fixed support in the direction of progression and the endless conveyor belt is imposed with the descending rectilinear trajectory at a point opposite to the minimum air gap.

12. A separator by Foucault current for removing non-magnetizable conductive elements from a mixture of materials, comprising:

an endless conveyor belt configured to transport the mixture of materials;

rotary drums on which the endless conveyor belt runs, at least one of the rotary drums driving the endless conveyor belt in a direction of progression along an outward path comprising an acceleration section in which the endless conveyor belt is configured to drive the mixture of materials at a speed of the endless conveyor belt;

a first fixed support and a second fixed support, wherein the endless conveyor belt is stretched tight between the first fixed support and the second fixed support so as to define a sorting section, wherein the endless conveyor belt is in contact with the first and second fixed supports to impose a descending rectilinear trajectory to the endless conveyor belt in the sorting section; and a multipole magnetic rotor being different from the first fixed support and the second fixed support and arranged between the first fixed support and the second fixed support so that the endless conveyor belt is separated from the multipole magnetic rotor only by an air-gap, the multipole magnetic rotor being configured to generate an alternating magnetic field passing through the endless conveyor belt and to divert the non-magnetizable conductive elements passing by the sorting section, wherein the first fixed support comprises a first planar surface and the second fixed support comprises a second planar surface, the first planar surface being parallel to the second planar surface, and the first and second planar surfaces being in contact with the endless conveyor belt so as to impose the descending rectilinear trajectory on the endless conveyor belt.

* * * * *